United States Patent [19]

Ferrari

[11] 4,448,333

[45] May 15, 1984

[54] FLEXIBLE CONTAINER AND EXPELLER

[76] Inventor: Mario Ferrari, 8 Holden Rd., Cherry Hill, N.J. 08034

[21] Appl. No.: 350,110

[22] Filed: Feb. 18, 1982

Related U.S. Application Data

[63] Continuation of Ser. No. 100,898, Dec. 6, 1979, Pat. No. 4,316,556.

[51] Int. Cl.[3] ..... B05B 11/04

[52] U.S. Cl. ..... 222/214; 222/103

[58] Field of Search ..... 222/94, 95, 494, 101, 222/102, 214, 107, 92, 215, 99, 100, 97, 98, 103

[56] References Cited

U.S. PATENT DOCUMENTS 3,313,455 4/1967 Kemmer ..... 222/103

4,363,509 8/1979 Amneus ..... 222/95

*Primary Examiner*—Stanley H. Tollberg

*Attorney, Agent, or Firm*—Weiser, Stapler & Kimmelman

[57] ABSTRACT

A flexible tube and closure includes a hollow body which terminates forwardly in a closable nozzle and rearwardly in a sealed area to retain a paste-like material therewithin. An expeller is movable from the rear sealed closure towards the front opening to rearwardly squeeze the body to force the material toward the front opening. A flattened section extends rearwardly from the closure and connects to the expeller in a loop configuration to aid in grasping and functioning the device. Longitudinally extending strips including corrugations may be provided exteriorly of the body to facilitate operation of the expeller.

7 Claims, 5 Drawing Figures

FLEXIBLE CONTAINER AND EXPELLER

This is a continuation, of application Ser. No. 100,898, filed Dec. 6, 1979 now U.S. Pat. No. 4,316,556.

BACKGROUND OF THE INVENTION

The present invention relates generally to the field of flexible tubes and more particularly is directed to an improved combination flexible tube and expeller suitable to apply measured quantities of a semi-liquid or paste-like material.

It is well known to employ collapsible tubes to retain and dispense numerous types of paste-like or semi-liquid products such as toothpaste, shaving cream, food products, etc. Metallic type collapsible tubes have long been employed for this purpose, whereby upon squeezing, small quantities of the stored material can be applied through a nozzle directly to the area of use, for example a tooth brush.

More recently, it has been attempted to utilize non-metallic collapsible tubes for similar purposes. Such tubes have been fabricated from usual types of sheet plastic materials which can be easily heat sealed or otherwise treated to the desired configurations for containing and dispensing a paste-like material.

While the metallic type of tube can usually be rolled at the bottom as the product is dispensed from the nozzle to thereby maintain a relatively tightly packed storage space as less and less material is retained, the flexible or plastic type of container can not be so rolled inasmuch as such collapsible type tubes inherently tended to unroll. When part of the semi-liquid contents has been expelled, the remainder can not be forced to remain near the nozzle. Rather, the very flexible nature of the tube causes the device to relax and the material can spread throughout the tube. Accordingly, as more and more product was dispensed or used, the partially filled flexible tubes were then increasingly more awkward to handle and required greater effort in dispensing through the nozzle.

SUMMARY OF THE INVENTION

The invention relates generally to the field of semi-liquid material containers and dispensers, and more particularly, is directed to a flexible tube-like container of elongate configuration which is equipped with a movable expeller suitable to urge the material contents from the rear of the tube toward a front opening for dispensing purposes.

The container comprises generally a tubular body which is fabricated of a soft, pliable or flexible material which may be a sheet plastic such as vinyl, which is formed to a generally hollow, cylindrical configuration. The body terminates forwardly in a conical shoulder to which a nozzle is affixed for dispensing purposes in a conventional manner. The rearward extent of the container is defined by a crimping, heat sealed seam or other closure, which closure can be applied in well known manner after the container has been filled with the paste-like material to be stored and dispensed.

Preferably, the body extends rearwardly, in either single or double thickness from the crimped area and is bent to form a dispensing loop of sufficient size to enable the user's finger to be inserted into the loop for product application, as hereinafter more fully set forth. An expeller including a narrow slot is movable over the flexible walls of the container from a rearward position immediately forwardly of the crimped or otherwise sealed area to a forward position near the nozzle. It is the purpose of the expeller to squeeze the walls of the container together into a flat configuration as the expeller is forwardly moved relative to the container body to thereby force the container contents forwardly to exit through the forward nozzle. As the expeller is forwardly urged, the emptied and flattened portions of the container integrally join with and expand the loop.

In a modified embodiment of the invention, the container body sidewalls can be equipped with integral, single or diametrically opposed pairs of strips including corrugations or fins which can be employed in conjunction with the expeller to permit forward movement of the expeller relative to the container body and to prohibit rearward movement of the expeller. In this manner, once a portion of the container has been emptied, the longitudinal position of the expeller will be locked relative to the body to thereby prevent partial refilling of the emptied rearward area.

It is therefore an object of the present invention to provide an improved flexible container and expeller of the type set forth.

It is another object of the present invention to provide a novel flexible container and expeller that may be easily fabricated of inexpensive material by utilizing well-known sheet plastic fabricating machinery and techniques.

It is another object of the present invention to provide a novel flexible container and expeller which comprises a flexible, plastic body and expeller means movable relative to the body to urge the container contents forwardly toward a forward positioned nozzle for dispensing purposes.

It is another object of the present invention to provide a novel flexible container and expeller comprising a body having squeezable sidewalls, the body terminating forwardly in a dispensing nozzle and rearwardly in a crimped or sealed area, and expeller means movable relative to the body forwardly from the rearward sealed area toward the nozzle for material dispensing.

It is another object of the present invention to provide a novel flexible container and expeller including a body having forward nozzle dispensing means and rearward sealed means, expeller means movable forwardly relative to the body from the rearward sealed means toward the nozzle dispensing means and an operating loop extending rearwardly from the rearward sealed means and joining the expeller means whereby the container may be securely grasped at the operating loop as the expeller means is urged forwardly for dispensing purposes.

It is another object of the present invention to provide a novel flexible container and expeller that is simple in construction, inexpensive in manufacture and trouble free when in operation.

Other objects and a fuller understanding of the invention will be had by referring to the following description and claims of a preferred embodiment thereof, taken in conjunction with the accompanying drawings wherein like reference characters refer to similar parts throughout the several views and in which:

DESCRIPTION OF THE PREFERRED EMBODIMENT OF THE INVENTION

Figure 1:
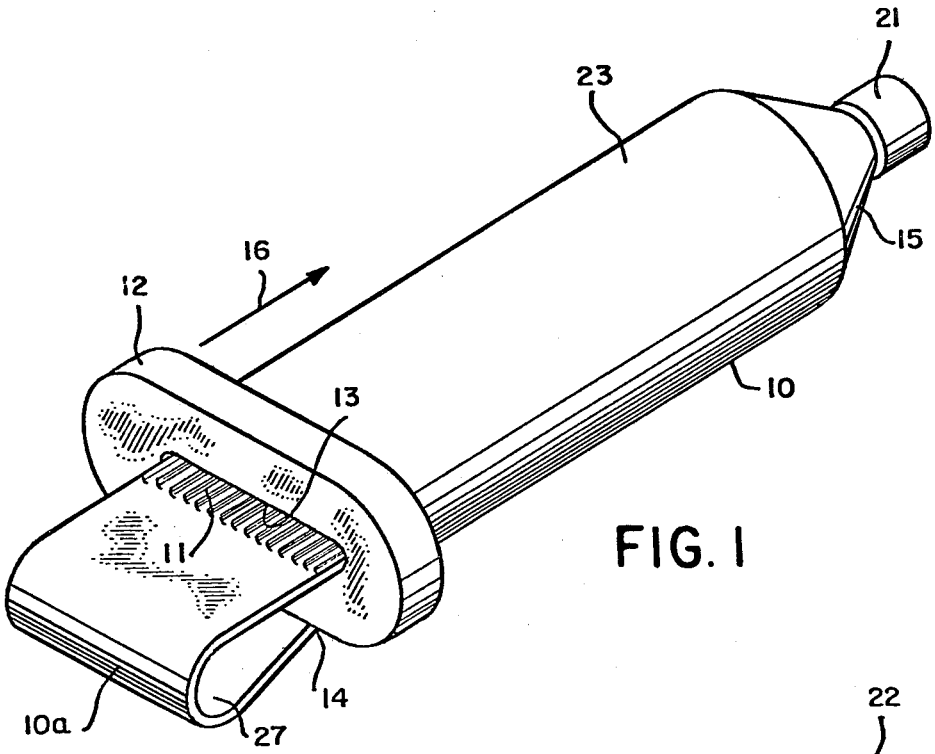
FIG. 1 is a perspective view of a flexible container and expeller constructed in accordance with the teachings of the present invention.

Although specific terms are used in the following description for the sake of clarity, these terms are intended to refer only to the particular structure of the invention selected for illustration in the drawings, and are not intended to define or limit the scope of the invention.

Figure 2:
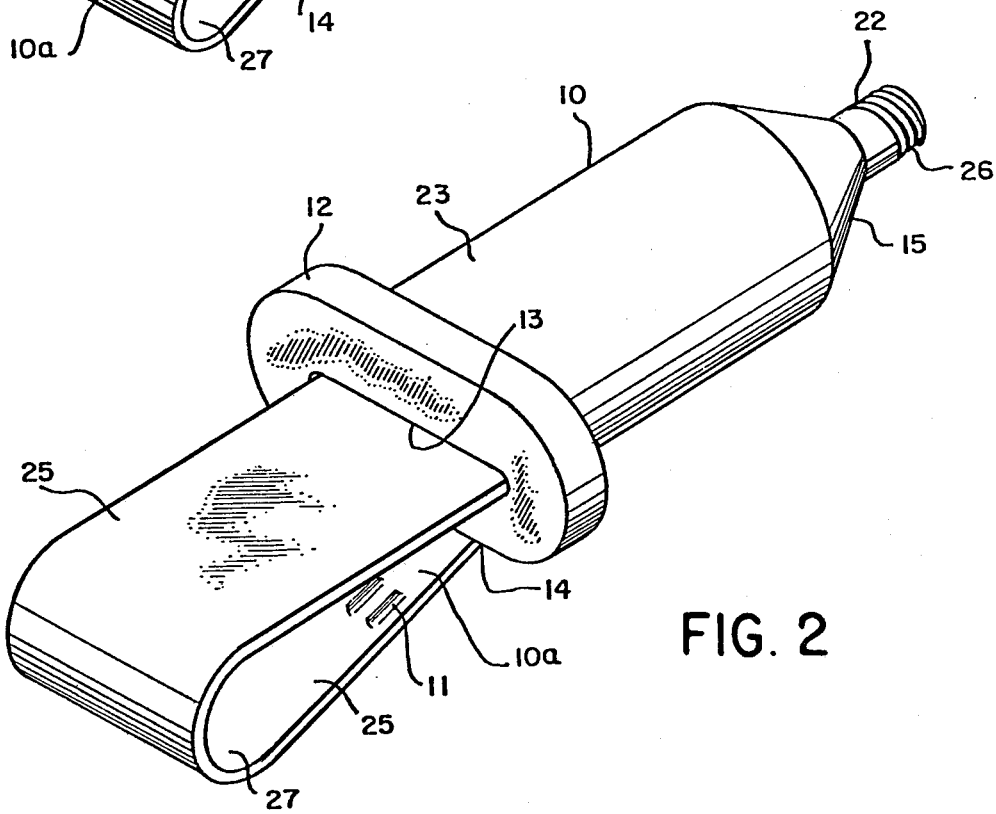
FIG. 2 is a view similar to FIG. 1 showing the container partially emptied and illustrated with the cap removed from the nozzle.

Referring now to the drawings, in FIGS. 1 and 2, there is illustrated a flexible container including a body 10 having sidewalls 23 formed of a flexible, pliable material to a generally cylindrical, hollow configuration. The container sidewalls 23 may be fabricated of any suitable, flexible material such as sheet vinyl or other sheet plastic material which can be formed to the cylindrical configuration whereby a semi-liquid material such as toothpaste, shaving cream, certain medicines in paste form, or the like may be stored prior to dispensing.

The container body terminates forwardly in a truncated conical shoulder 15 which is configured for optimum material dispensing purposes. The shoulder 15 terminates forwardly in a nozzle 22 which may be threaded at 26 to receive the cap 21. In accordance with usual dispensing tube constructions, the nozzle 22 is hollow and is in fluid communication with the interior of the body 10 to permit the material contents 29 of the body to exit therethrough as hereinafter more fully set forth.

The body 10 terminates rearwardly in a flattened area 11 which is crimped, heat sealed or otherwise closed to define the rearward extent of the hollow body wherein the semi-liquid materials 29 may be stored. For ease in filling and in construction, it is contemplated that the body 10 will first be filled from the rear utilizing any suitable known type of semi-liquid material filling apparatus. When the body 10 is fully packed, the crimped or sealed area is then formed in known manner, for example by heat sealing. It is noteworthy that the expeller is positioned over the container sidewalls 23 immediately forwardly of the flat, sealed area 11. Normally, when the container is filled, the sidewalls will be urged to a cylindrical configuration as illustrated in FIG. 1. As the expeller 12 is forwardly moved to dispense the contents 29 through the nozzle 22 the rearward portions of the body sidewalls are flattened by action of the expeller, as seen in FIG. 2 to form the flattened rear body extention.

Figure 4:
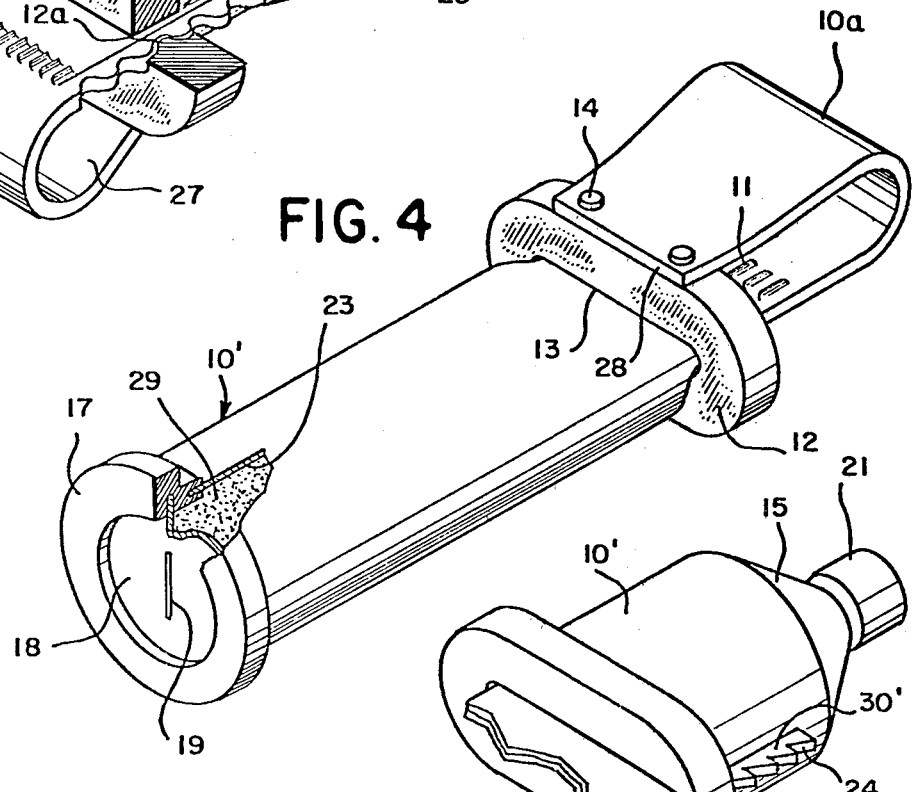
FIG. 4 is a bottom perspective view of another embodiment of a flexible container and expeller, partially broken away to expose interior construction details.

In a modified nozzle arrangement as illustrated in FIG. 4, the shoulder, nozzle and cap construction of FIGS. 1 and 2 may be replaced by an automatically functioning dispensing arrangement. In this embodiment, the body sidewalls 23 terminate forwardly in a collar 17 which is securely affixed thereto. The collar includes an inner peripheral groove within which the outer periphery of a flexible diaphragm is retained. The diaphragm 18 includes an operable slit or dispensing opening 19 which is normally closed to thereby retain the material 29 within the container. Upon forward movement of the expeller 12, sufficient forces are built up interiorly of the container to flex the diaphragm 18 and thus force open the slit 19 whereby the material 29 will exit from the container.

The movable expeller 12 can be fabricated of relatively hard, thick plastic material of generally oval configuration and is provided with a slot 13 through which the flattened extension 25 of the container body 10 extends. As best seen in FIG. 1, the expeller is intended to be moved forwardly relative to the container 10 from the crimped or sealed area 11 toward the nozzle 22 in the direction indicated by the arrow 16. Accordingly, in order to dispense the paste-like product 29 stored within the container body 10, it is the purpose of the invention to allow the operator to urge the expeller 12 forwardly in the direction of the arrow 16. The forward movement of the expeller forces the container contents toward the nozzle 22 and outwardly of the container for dispensing at a desired location.

As illustrated, the body sidewalls 23 extend rearwardly of the crimped area 11 in a flattened section 10*a*, which section is bent in a U-shaped turn to form a grasping loop 27. The end 28 of the flattened section 10*a* preferably is attached to a portion of the expeller 12 in a secure, known connection, such as by employing fasteners 14 or by adhesives, heat sealing or other known connecting techniques.

As best seen in FIG. 2, the expeller 12 functions to push the stored material 29 forwardly as the expeller is pushed in the direction of the arrow 16. The stored material exits through the nozzle 22 and the expeller functions to maintain the cylindrical configuration in the forward portion of the container body 10 by keeping the forward portion packed full. As the expeller 12 is moved forwardly along the body 10, the rearward portion of the body from which the stored material 29 has been expelled is flattened by the action of the expeller slot 13 whereby the flattened extension 25 is formed. The flattened extension integrally extends from the flattened section 10*a* rearwardly of the crimped or sealed area 11. Accordingly, as the expeller 12 is moved forwardly in the direction of the arrow 16, the combination of the flattened area 10*a* and flattened extension 25 causes the grasping loop 27 to enlarge as illustrated, while the forward section of the container body 10 remains full and firmly packed with the remainer of the stored material 29.

Figure 3:
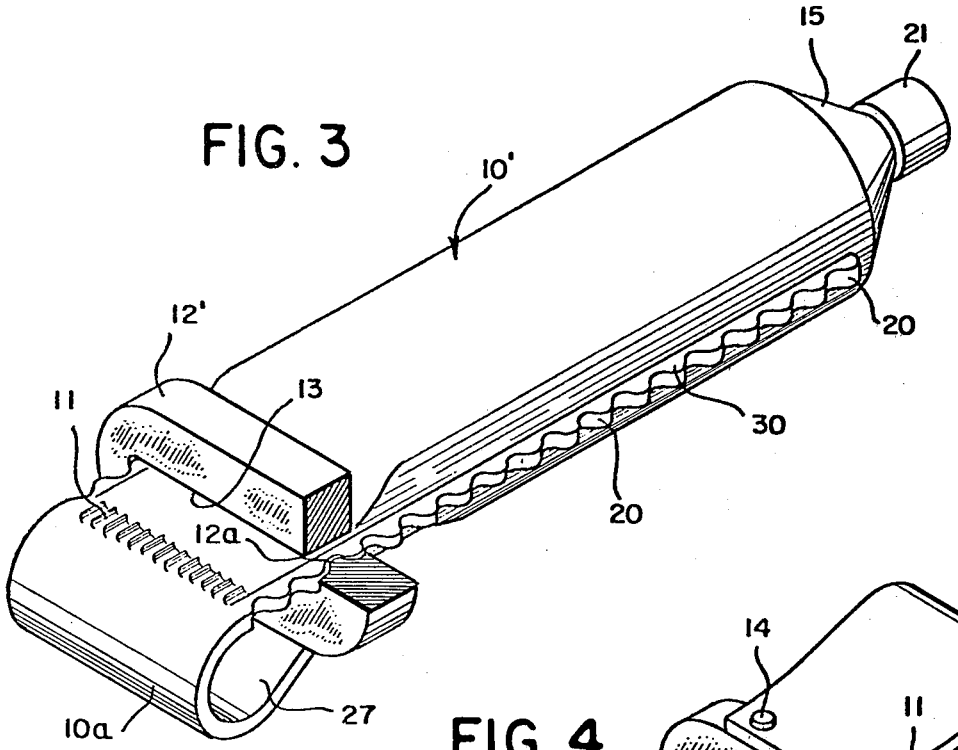
FIG. 3 is a top perspective view similar to FIG. 1 showing a modified embodiment thereof, a portion of the expeller being broken away to disclose interior construction details.

Referring now to FIG. 3, in a modified embodiment of the invention, the container body 10′ may be provided with one or more longitudinally extending strips 30 comprising a plurality of measuring corrugations 20.

Figure 5:
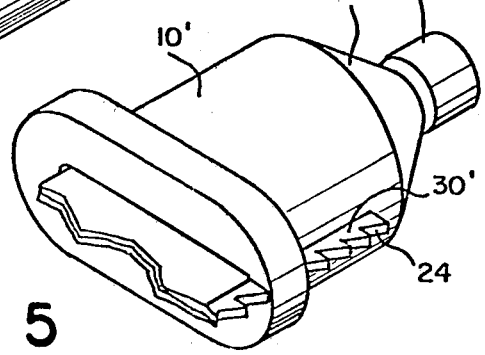
FIG. 5 is a partial perspective view showing a modified embodiment of the longitudinal strip construction of FIG. 3.

As illustrated, the corrugations 20 may be employed to permit measured quantities of material 29 to be dispensed through the nozzle 22. If, for example, the expeller was moved forwardly a distance of one corrugation 20 then a measured quantity would be forced through the nozzle. If the expeller 12 was pushed forwardly a distance of two corrugations 20, then twice the amount of material 19 would be expelled. In FIG. 5, the modified longitudinal strip 30 may be formed with a plurality of saw tooth configured teeth which can be formed to permit a modified expeller to move in a forward direction along the body 10′ and to discourage rearward movement of the expeller. In this manner, as the contents 29 of the container are used, the remainder will always be urged toward the nozzle 22. The unused portion will be forced out of the flattened extension 25 and into the cylindrical forward section of the container. See FIG. 2. Accordingly, it is intended that the expeller 12' can be readily pushed forwardly along the container body 10' and that the corrugations 20 of the strip 30 or the teeth 24 of the modified strip 30' will function to lock the expeller 12' in a forward position and to discourage rearward movement of the expeller once it has been forwardly urged. If desired, the lateral ends of the groove 13 of the modified expeller 12' can be formed with cooperating corrugations 12*a* which are configured to cooperate with and lock upon the exterior corrugations 20 of the strip 30 or upon the teeth 24 of the modified strip 30.

In order to use the flexible container and expeller of the present invention, the container body 10 or 10' is first filled with a material 29 to be stored and subsequently dispensed therefrom, utilizing known equipment and known techniques. After filling, the stored material 29 is retained within the container body between the front nozzle 22 and the rearwardly sealed area 11. In use, the cap 21 is unthreaded from the nozzle 22 in the usual manner and the container is grasped in one hand at the loop 27 which initially comprises only the flattened section 10*a*. Then, with the other hand, the expeller 12 is forwardly urged in the direction of the arrow 16 to thereby push the stored material 29 toward the nozzle 22 for dispensing. As the stored material 29 is expelled through the nozzle 22, the expeller groove 13 acts to squeeze the body sidewalls 23 together to form the flattened extension 25. See FIG. 2. As illustrated, the flattened extension 25 integrally extends rearwardly from the flattened area 10*a* to thus enlarge the grasping loop 27 as the stored material is used. To prevent rearward movement of the expeller 12 relative to the body 10 after it has reached a medial position, such as illustrated in FIG. 2, or to provide a measuring dispenser, one or more retainer strips 30, 30' may be longitudinally applied exteriorly of the body 10' to thereby lock the expeller in desired position forwardly of the crimped or sealed area 11.

Although the invention has been described with a certain degree of particularity, it is understood that the present disclosure has been made only by way of example and that numerous changes in the details of construction and the combination and arrangement of parts may be resorted to without departing from the scope of the invention.

What is claimed is:

1. A flexible container comprising:

a body having flexible sidewalls, which sidewalls define a compressible storage space, the body terminating forwardly in a content dispensing opining and rearwardly in a closure which prevents escape of the contents, at least one strip extending longitudinally of said storage space and projecting laterally from one side of said body sidewalls, said strip having a plurality of lateral corrugations spaced-apart along said storage space, said corrugations defining distances along the storage space, whereby predetermined fractions of its contents may be dispensed by compressing the storage space up to a given corrugation, and expeller means positioned between the closure and the dispensing opening, and being movable relative to the body from one of said corrugations to another, the expeller means being so constructed as to engage the body in such manner that said movement progressively compresses the storage space between the two corrugations in a direction substantially perpendicular to the direction of lateral projection of said strip and urges the contents in said compressed space toward the dispensing opening.

2. The container of claim 1 wherein the corrugations are substantially uniformly spaced apart along the storage space and of substantially uniform configuration.

3. The container of claim 2 having two of said strips on opposite sides of the storage space, respectively.

4. The container of claim 1 wherein the corrugations are substantially sinusoidal in shape.

5. A flexible container comprising:

a body having flexible sidewalls, which sidewalls define a compressible storage space, the body terminating forwardly in a content dispensing opining and rearwardly in a closure which prevents escape of the contents, at least one strip extending longitudinally of said storage space and projecting laterally from said body sidewalls, said strip having a plurality of lateral corrugations spaced-apart along said storage space, said strip extending substantially along the entire length of said storage space, and said corrugations defining distances along the storage space, whereby predetermined fractions of its contents may be dispensed by compressing the storage space up to a given corrugation.

6. A flexible container comprising:

a body having flexible sidewalls, which sidewalls define a compressible storage space, the body terminating forwardly in a content dispensing opining and rearwardly in a closure which prevents escape of the contents, at least one strip extending longitudinally of said storage space and projecting laterally from said body sidewalls, said strip having a plurality of lateral corrugations spaced-apart along said storage space, said corrugations defining distances along the storage space, whereby predetermined fractions of its contents may be dispensed by compressing the storage space up to a given corrugation, and said corrugations being substantially sawtooth-like in shape.

7. The container of claim 6, wherein the sloping portion of each sawtooth slopes inwardly toward the rear of the body.

* * * * *